US008082669B2

(12) United States Patent
Hayes

(10) Patent No.: US 8,082,669 B2
(45) Date of Patent: Dec. 27, 2011

(54) DOUBLE HANDLE KITCHEN KNIFE

(76) Inventor: Brian William Hayes, Homer, AK (US)

( * ) Notice: Subject to any disclaimer, the term of this patent is extended or adjusted under 35 U.S.C. 154(b) by 409 days.

(21) Appl. No.: 12/475,606

(22) Filed: Jun. 1, 2009

(65) Prior Publication Data

US 2009/0229132 A1 Sep. 17, 2009

Related U.S. Application Data

(63) Continuation-in-part of application No. 12/389,040, filed on Feb. 19, 2009, which is a continuation-in-part of application No. PCT/US2008/083372, filed on Nov. 13, 2008, which is a continuation-in-part of application No. 12/258,384, filed on Oct. 24, 2008, which is a continuation-in-part of application No. 12/198,893, filed on Aug. 27, 2008, now abandoned, which is a continuation-in-part of application No. 12/134,208, filed on Jun. 6, 2008, now abandoned, which is a continuation-in-part of application No. 11/949,782, filed on Dec. 4, 2007, now Pat. No. 7,726,030.

(60) Provisional application No. 61/840,137, filed on Dec. 24, 2008.

(51) Int. Cl.
*B26B 3/00* (2006.01)

(52) U.S. Cl. ..... 30/312; 30/296.1; 30/340

(58) Field of Classification Search ..... 30/123, 30/142, 147–149, 233, 235, 241, 228, 272.1, 30/277.4, 295, 329, 340, 342, 337, 320, 392, 30/296.1, 298, 312, 299–307; D7/646, 649, D7/650, 381, 385, 401.2; D8/98, DIG. 1, D8/DIG. 4, 107; 452/161, 164, 132, 132.6; 16/110.1, 111.1, 431, 900, 445, 442, 430
See application file for complete search history.

(56) References Cited

U.S. PATENT DOCUMENTS

| | | | | | |
|---|---|---|---|---|---|
| 25,818 | A | * | 10/1859 | Goodall | 30/298 |
| 108,141 | A | * | 10/1870 | Houseman et al. | 30/295 |
| 165,841 | A | * | 7/1875 | Kellogg | 30/312 |
| 173,955 | A | * | 2/1876 | Hudson | 30/320 |
| 226,146 | A | * | 3/1880 | Zimmerer | 30/299 |
| 230,393 | A | * | 7/1880 | Barker et al. | 30/340 |
| 235,425 | A | * | 12/1880 | Gearon | 30/312 |
| 296,304 | A | * | 4/1884 | Allen | 30/312 |
| 331,915 | A | | 12/1885 | Smith | |

(Continued)

FOREIGN PATENT DOCUMENTS

| | | | |
|---|---|---|---|
| EP | 162995 | A1 * | 12/1985 |
| FR | 2600574 | A1 * | 12/1987 |
| JP | 11300058 | | 11/1999 |
| JP | 2002/045581 | | 2/2002 |
| WO | PCT/US2008/083372 | | 1/2009 |

OTHER PUBLICATIONS

Dexter-Russel Product No. 09210; catalog No. S18914.
Dexter-Russel Product No. 18000; catalog No. S161.

*Primary Examiner* — Jason Daniel Prone

(57) ABSTRACT

Double handle knives and attachments to convert a knife to a double handle knife are described with secondary handles able to form an angle (a) between about 20 to 70 degrees between the long axis of the secondary handle and the long axis of the blade in a plane at about right angles to the blade. Embodiments describe fixed, rotatable, and indexable means for the angle of attachment of the secondary handle to the blade. Embodiments further describe reversible and permanent means of attachment. The placement of the secondary handle at the angle described allows for the optimal positioning of the hands for both controlling and assisting with the cutting of foods and other items.

31 Claims, 15 Drawing Sheets

U.S. PATENT DOCUMENTS

| | | | | | |
|---|---|---|---|---|---|
| 369,314 | A | * | 9/1887 | Brougher | 30/295 |
| 391,268 | A | * | 10/1888 | Parker | 30/123 |
| 431,584 | A | * | 7/1890 | Holland | 30/155 |
| 492,409 | A | * | 2/1893 | May | 30/295 |
| D22,439 | S | * | 5/1893 | McGuigan | D7/649 |
| 538,459 | A | * | 4/1895 | McCausland | 30/307 |
| 605,577 | A | * | 6/1898 | Hutchinson | 30/521 |
| 649,059 | A | * | 5/1900 | Kern | 30/295 |
| 673,506 | A | * | 5/1901 | Pitts | 30/295 |
| 682,624 | A | * | 9/1901 | Klickman | 30/295 |
| 682,938 | A | * | 9/1901 | Ingram | 30/295 |
| 696,050 | A | | 3/1902 | Iwan | |
| 725,811 | A | * | 4/1903 | Asbell | 30/123 |
| 797,461 | A | * | 8/1905 | Schultz | 30/298 |
| 898,574 | A | * | 9/1908 | Gotchall | 30/340 |
| 907,345 | A | * | 12/1908 | Halfmann | 30/298 |
| 983,736 | A | * | 2/1911 | Maconochie | 30/295 |
| 986,166 | A | | 3/1911 | Hass | |
| 1,008,088 | A | | 11/1911 | Swineford | |
| 1,082,363 | A | | 12/1913 | Slusser | |
| 1,110,946 | A | | 9/1914 | Lahiere | |
| 1,118,507 | A | | 11/1914 | Meyer | |
| 1,178,363 | A | | 4/1916 | Waring | |
| 1,222,366 | A | | 4/1917 | Curry | |
| 1,294,609 | A | * | 2/1919 | Boone | 30/299 |
| 1,333,960 | A | | 3/1920 | Brehm | |
| 1,491,623 | A | | 4/1924 | Pitchur | |
| 1,504,501 | A | | 8/1924 | Pope | |
| 1,505,444 | A | | 8/1924 | Swanson | |
| 1,530,796 | A | * | 3/1925 | Thomsen | 30/304 |
| 1,589,156 | A | | 6/1926 | Hartman | |
| 1,687,403 | A | | 10/1928 | Stafford | |
| 1,706,918 | A | | 4/1929 | Erikson | |
| 1,750,577 | A | | 3/1930 | DeBracht | |
| 1,755,351 | A | | 4/1930 | Felardo | |
| 1,863,153 | A | * | 6/1932 | Christopherson | 30/293 |
| 1,935,149 | A | * | 11/1933 | Elvin | 30/123 |
| 2,217,100 | A | | 10/1940 | Burns | |
| D131,152 | S | * | 1/1942 | Jacobs | D7/643 |
| D131,224 | S | | 1/1942 | Parisi | |
| 2,560,271 | A | | 7/1951 | Block | |
| 2,582,988 | A | * | 1/1952 | Harvey | 30/295 |
| 2,590,709 | A | | 3/1952 | Kahn | |
| 2,650,424 | A | | 9/1953 | Kalmon | |
| 2,737,719 | A | * | 3/1956 | Ember et al. | D7/650 |
| 2,739,498 | A | | 3/1956 | Champlin | |
| 2,748,477 | A | | 6/1956 | Smith | |
| 2,776,680 | A | * | 1/1957 | Waddell | 30/392 |
| 2,782,787 | A | | 2/1957 | Cary | |
| D183,290 | S | * | 7/1958 | Shock | D8/DIG. 1 |
| 3,593,419 | A | * | 7/1971 | Hula | D7/650 |
| 4,028,806 | A | * | 6/1977 | Sheldon | 30/296.1 |
| 4,054,994 | A | | 10/1977 | Grossman | |
| 4,095,337 | A | | 6/1978 | Pharr | |
| D255,974 | S | | 7/1980 | Jacoby | |
| 4,247,984 | A | * | 2/1981 | McArdle et al. | 30/296.1 |
| 4,601,102 | A | * | 7/1986 | Phillips | 30/123.5 |
| 4,716,653 | A | * | 1/1988 | Skyba | 30/296.1 |
| 4,967,476 | A | | 11/1990 | Mozeliak | |
| 4,980,977 | A | | 1/1991 | Matin | |
| 5,113,587 | A | | 5/1992 | Loomis | |
| D391,115 | S | | 2/1998 | Roberton | |
| 5,784,787 | A | | 7/1998 | Jensen | |
| D397,282 | S | | 8/1998 | Derkatz | |
| 5,920,992 | A | | 7/1999 | Watermolen et al. | |
| 6,079,758 | A | | 6/2000 | Romero | |
| D445,643 | S | | 7/2001 | Kazaklaris | |
| 6,254,293 | B1 | | 7/2001 | Citrenbaum | |
| 6,381,855 | B1 | | 5/2002 | Lin | |
| D461,681 | S | * | 8/2002 | Lothe | D7/401.2 |
| D461,688 | S | * | 8/2002 | Lothe | D7/649 |
| 6,493,946 | B1 | | 12/2002 | Carrillo | |
| D538,591 | S | | 3/2007 | Aston, III | |
| D539,085 | S | * | 3/2007 | Aston, III | D7/401.2 |
| D539,086 | S | * | 3/2007 | Aston, III | D7/401.2 |
| 7,726,030 | B2 | * | 6/2010 | Hayes | 30/312 |
| 2002/0170184 | A1 | * | 11/2002 | Lothe | 30/295 |
| 2004/0010923 | A1 | | 1/2004 | Guiver | |
| 2005/0097759 | A1 | | 5/2005 | Igarashi | |
| 2009/0139096 | A1 | | 6/2009 | Hayes | |
| 2009/0139097 | A1 | | 6/2009 | Hayes | |
| 2009/0139098 | A1 | | 6/2009 | Hayes | |
| 2009/0142463 | A1 | | 6/2009 | Hayes | |
| 2009/0151172 | A1 | | 6/2009 | Hayes | |

* cited by examiner

DOUBLE HANDLE KITCHEN KNIFE

CROSS-REFERENCES TO RELATED APPLICATIONS

This application is a continuation-in-part and claims priority under 35 U.S.C. 120 of U.S. patent application Ser. No. 12/389,040, filed on Feb. 19, 2009, entitled Double Handle Kitchen knife, which is a continuation-in-part of PCT/US08/83372, filed on Nov. 13, 2008, entitled Double Handle Kitchen Knife, which is a continuation-in-part of U.S. patent application Ser. No. 12/258,384, filed on Oct. 24, 2008, entitled Double Handle Kitchen knife, which is a continuation-in-part of U.S. patent application Ser. No. 12/198,893, filed on Aug. 27, 2008 now abandoned, entitled Double Handle Kitchen Knife, which is a continuation-in-part of U.S. application Ser. No. 12/134,208, filed on Jun. 6, 2008 now abandoned, entitled Double Handle Kitchen Knife, which is a continuation-in-part of U.S. patent application Ser. No. 11/949,782, filed Dec. 4, 2007, entitled Double Handle Kitchen Knife, which is now U.S. Pat. No. 7,726,030. This application also claims the benefit under 35 U.S.C. 119(e) of U.S. provisional application Ser. No. 61/840,137 filed Dec. 24, 2008, entitled Handle Attachment for Blades. All of the above application are incorporated by reference herein.

REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of Invention

This invention refers to double handle knives and blades and handle attachments to convert a knife or single handle blade into a double handle blade, and specifically to improvements in the positioning of the secondary handle that allow for greater ease and accuracy in the cutting of food items and other objects.

2. Background of Invention

The vast majority of kitchen knives in use today employ conventional handles extending off the back end of a blade whereas the front of the blade comes to a point. These knives allow a user to grip the knife with their dominant hand leaving their non-dominant hand free to control the food item or other object being cut. This arrangement allows precise cutting of the item but has the disadvantage that the dominant hand is doing most of the work. This often leads to hand and wrist fatigue especially for the elderly, people predisposed to wrist injury, and others who prepare a lot of difficult to cut foods such as carrots, squash, pumpkins, potatoes, frozen foods, and so forth. To help alleviate this, people sometimes use their non-dominant hand to assist their dominant hand in cutting through a food or other item. This may be done by positioning the food item with the palm and thumb of the non-dominant hand while simultaneously using the index and middle fingers of the same to press down on the top front of a blade, gripping the handle with the dominant hand and raising it to clear the food item, then levering down cutting through it with the assistance of the non-dominant hand. However, pressing down on the top of the thin blade with the fingers can be very uncomfortable and limits the downward force that is possible.

Double handle knives, in addition to a primary handle used by the dominant hand, provide a secondary handle for use by the non-dominant hand so that both hands can comfortably apply downward pressure on broad handles. Using the four available fingers (thumb excluded) of the non-dominant hand to press down evenly on the secondary handle would provide maximum benefit and minimize hand and wrist fatigue. However none of the prior art double handle knives provide secondary handles designed for the dual purpose of allowing the palm and thumb of the non-dominant hand to remain close to the blade to control short pieces of food while also leaving the remaining four fingers of the same hand in a position to press down evenly on the secondary handle. This includes those that require both hands to wrap around the handles as disclosed in patents: A. Haas U.S. Pat. No. 986,166 and Li Xiaoping Chinese Pat. No. CN2247586Y with vertical handle grips; Watermolen and Peters U.S. Pat. No. 5,920,992 with rising handles with finger grips; Wang Xiaobo Japanese Pat. No. JP11300058 and John Erikson U.S. Pat. No. 1,706,918 with a secondary handle built on the back top of a knife blade; W. L. Iwan U.S. Pat. No. 696,050 with handles at right angles at the back of the blade.

Dexter-Russell (Product no. 09210) makes a double handle "cheese knife" with a conventional design handle on each end as well as a handle attachment (product no. 18000) for adding an additional handle to pizza knives. This attachment may conceivably be used to attach to a kitchen knife as well. Additionally, Carl Carrillo U.S. Pat. No. 6,493,946 made a knife guard that can be applied to the top of a blade and used as a secondary handle. With these designs, the long axis of the secondary handle is parallel to the blade. However, a parallel arrangement (see FIG. 2C) is not ideally suited for the dual purpose of pinning down the front of the knife and assisting in the cut while also positioning the food item for the cut as there is a tendency for the index finger to exert significantly greater downward pressure than the other fingers and for other reasons as discussed in the primary operation of the main embodiment.

Barker and Barbour U.S. Pat. No. 230,393 developed a handle attachment that adds an additional handle to knives intended for cutting cheese. The handle design is very high profile and not suited for both assisting in the cutting and controlling of food items by the non-dominant hand. Furthermore, the long axis of the handle is perpendicular to the blade. A perpendicular arrangement (see FIG. 2D) is not ideally suited for the dual purpose of assisting in the cut while also controlling the food item as the fingers are unevenly placed on the handle creating unnecessary side torque as downward pressure is applied. The dominant hand would have to counteract this torque to keep the blade straight thus creating more stress on the wrists.

J. P. Smith U.S. Pat. No. 331,915 developed a knife having a conventional handle on one end and a high profile round handle extending off the top of a blade. The high profile handle makes it convenient for cutting high blocks of cheese but more difficult for the dual purpose of both cutting and controlling food items with the non-dominant hand. Furthermore, a round handle doesn't provide an ideal arrangement for the dual purpose of both positioning the food item and levering maximum downward pressure to cut it: because if a round handle was large enough to accommodate all four fingers of the non-dominant hand, over 3" diameter, the fingers would be mostly contacting the handle on one side of the blade thereby creating side torque as downward pressure is applied (see FIG. 2E).

Yet another limitation of the prior art is when the non-dominant hand is not required for controlling the food item or other object: now that the non-dominant hand and arm are free to assume a variety of positions to find the one most effective for the given situation, they are limited by the fixed position of the secondary handle itself. This is especially true with harder to cut items.

SUMMARY OF INVENTION

Objects and Advantages

Accordingly, several objects and advantages of the main embodiment of my invention are:

(a) to provide a double handle blade with a secondary handle that may be positioned such that four fingers of the non-dominant hand may evenly press down on it while leaving the palm and thumb of the same hand in optimal position to control food or other items being cut;

(b) to provide a double handle blade with a secondary handle which pivots thereby allowing versatility in the positions that the non-dominant hand and arm may assume for assisting in the cutting of food or other items especially in those situations in which the non-dominant hand is not needed for positioning the same;

(c) to provide means that secondary handles of differing designs can be easily exchanged on the same blade thus further increasing its versatility;

(d) to provide means for easy secondary handle removal to facilitate one-handed operation of a blade as well as making it easier for cleaning, sharpening and storage of the blade;

Further objects and advantages of additional embodiments are:

(a) to provide a double handle blade or secondary handle attachment with permanent or reversible means to attach a secondary handle at an indexable or fixed angle to the blade at an optimal angle.

Still further objects and advantages will become apparent from a consideration of the ensuing description and drawings.

BRIEF DESCRIPTION OF THE DRAWINGS

Note that the specification relating to the following embodiments should be construed as an exemplary rather than as a limitative of the present invention, with many variations and modifications being readily attainable by a person of average skill in the art without departing from the spirit or scope thereof.

DRAWINGS

List of Reference Numerals

Figure 1A:
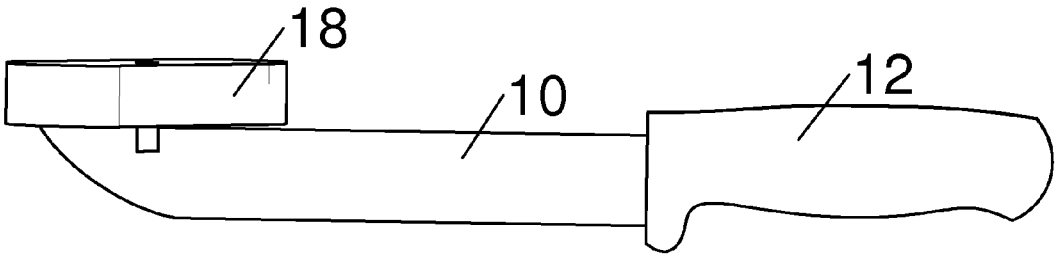
FIGS. 1A and 1B illustrate the basic components of the main embodiment of a rotating secondary handle knife design shown in fully assembled side elevation view in FIG. 1A and shown in detail view of FIG. 1B.

10 blade
12 primary handle
14 pivot post
16 slot
18 press pad—secondary handle version
20 hole
21 carrot food item
22 round handle
40 rotating secondary handle attachment
42 pivot post
44 clamping body
46 slot
48 Allen head set screw
50 blade
52 hole
56 lower mounting unit
58 slot

Figure 1B:
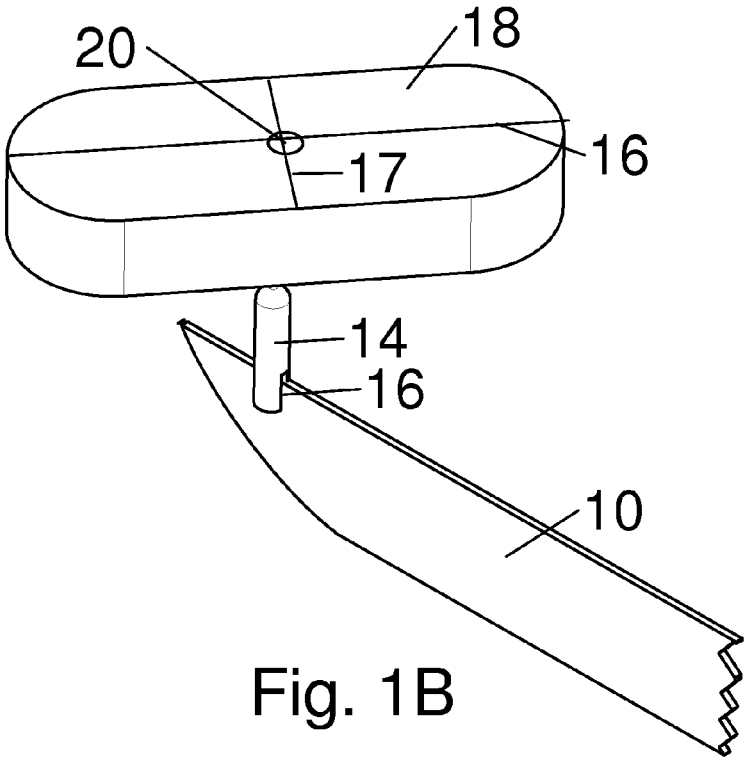

60 body
62 blind holes
64 pins
66 spring
70 end plate
72 release knob
74 connecting rods
80 secondary handle—bi-level version
82 lower section
84 hole
86 cross-member
88 upper section
90 secondary handle—crosswise-grip version
92 base
94 hole
96 bracket
98 handle grip
100 secondary handle—T-grip version
101 round handle grip
102 base
103 hole
104 thin connecting member
105 safety secondary handle
106 secondary handle
107 safety guard
109 rounded outer surface
110 magnetic mounting unit
112 housing
114 slot
116 fixed flat bar magnet
118 floating flat bar magnet
120 retracting knob and rod
122 backing plate
126 end portion
130 fixed angle secondary handle
132 blade
134 tang
140 fixed angle secondary handle attachment
142 handle press pad upper section
144 end portion
146 protruding lower mounting section
148 slot
149 Allen set screw
150 secondary handle
152 bushing
154 internal slot
156 tang
158 blade
166 second handle
168 hole
170 post
172 internal slot
180 secondary handle
182 tensioner hole
184 hole
186 tension band with thread housing
188 tensioner knob
190 band
200 O-ring
202 O-ring groove
204 pivot post
206 blade
210 splined post
212 blade
214 secondary handle
216 internal splines
220 pivot post
222 pivot post tabs
224 secondary handle
226 handle grooves
230 secondary handle
232 slots
242 square post
246 second handle
248 square hole
260 fixed-angle secondary handle attachment
262 end portion
264 press-pad upper portion
266 slot
270 mounting unit
272 pivot post
274 pads
276 slot
278 housing The main embodiment of the present invention is illustrated in FIGS. 1A and 1B: fully assembled in side view in FIG. 1A and a front close up in FIG. 1B. At the back of blade 10 a primary handle 12 is fastened (FIG. 1A). Primary handle 12 may be of though not limited to a conventional design. A pivot post 14 (FIG. 1B) of stainless steel round bar may be slotted 15 to fit over the top front of blade 10 and fastened by riveting, welding, soldering or other permanent means. Alternatively, the post may be cast or forged integral with the blade or a post may be fitted over a tang (see FIG. 8B). The blade may be made out of steel, ceramic, or other materials. A secondary handle 18 has a length or long axis 16 preferable greater than three inches to enable all four fingers (thumb excluded) of the non-dominant hand to press down on it and a width or short axis 17 having sufficient surface for the fingers to comfortably press down on but preferably less than two inches as wider widths introduce unnecessary side load as discussed below for the primary operation of the main embodiment.

Figure 9A:
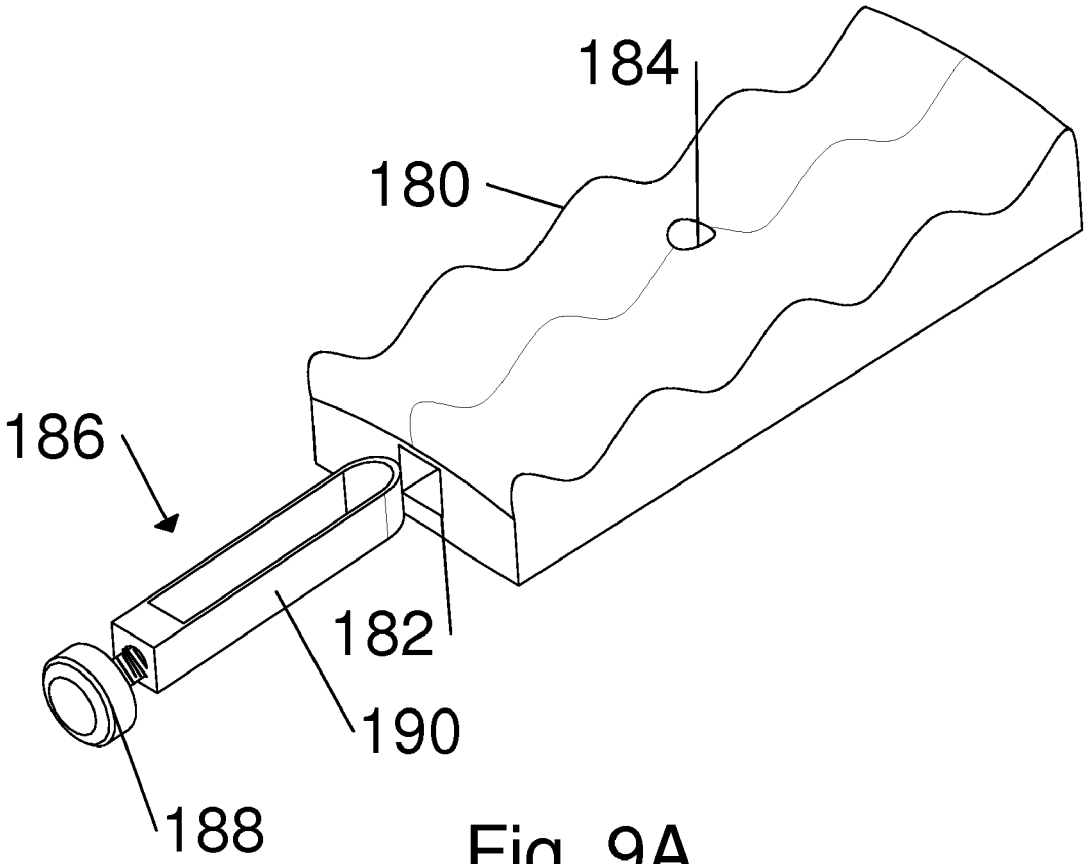
FIG. 9A is an exploded detail perspective view of an embodiment of a tensioner mechanism.
Figure 9B:
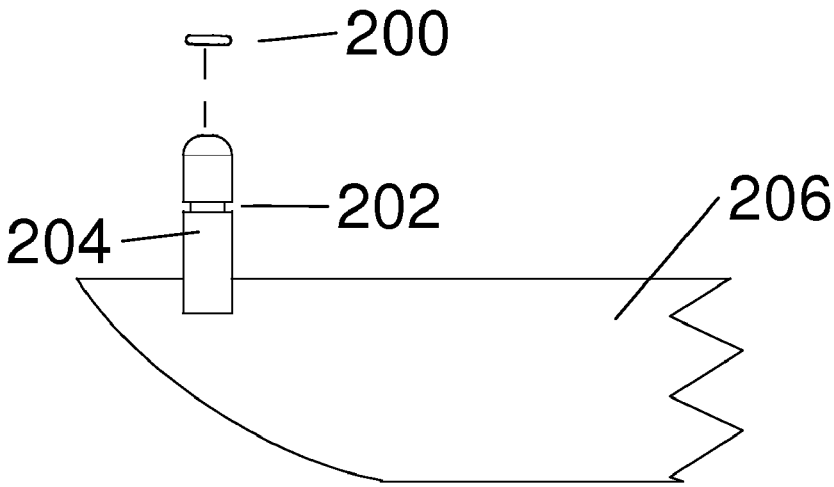
FIG. 9B is a close-up side-elevation view of a tensioner with O-ring groove.

Secondary handle 18 may be wooden or plastic, smooth or with finger slots on top and has a centrally located hole 20 (FIG. 1B) of close tolerance to pivot post 14 to enable rotating on pivot post 14 when assembled. The secondary handle may rest on the blade and has a height sufficient to accommodate the pivot post as lower profiles facilitate the cutting method as described in the primary operation of the main embodiment. The pivot post arrangement allows ready removal of secondary handle for cleaning, storage and sharpening of the blade 10. Furthermore, the close tolerance prevents secondary handle 18 from slipping off when the present invention is turned upside down but may be retained by fasteners which allow the handle 14 to still rotate such as a spring loaded ball bearing built into post 14 and a corresponding groove in hole 20, an O-ring fitted into a groove in post 14, or a flanged bolt which threads down into the top of the pivot post to retain the handle while still allowing it rotate. Optional tensioners to moderate the free rotation of the secondary handle are shown in FIGS. 9A and 9B. The handle may also carry a simple set screw to lock it in position against the pivot post if the same angle of handle rotation is required repeatedly. The secondary handle 18 may further carry a bearing or bushing insert with an inner diameter to match the pivot post outer diameter. The shape of the secondary handle 18 may be flattened rectangular, oblong, a piece of round bar, etc.

Furthermore, the pivot post may be mounted perpendicular to the long axis of blade 10, centered or parallel to a plane of the blade 10 as shown in FIGS. 1 A and B, thereby enabling pivoting of the secondary handle 18 in a plane above the top of the knife and at about right angles to a plane of the blade.

Figure 2A:
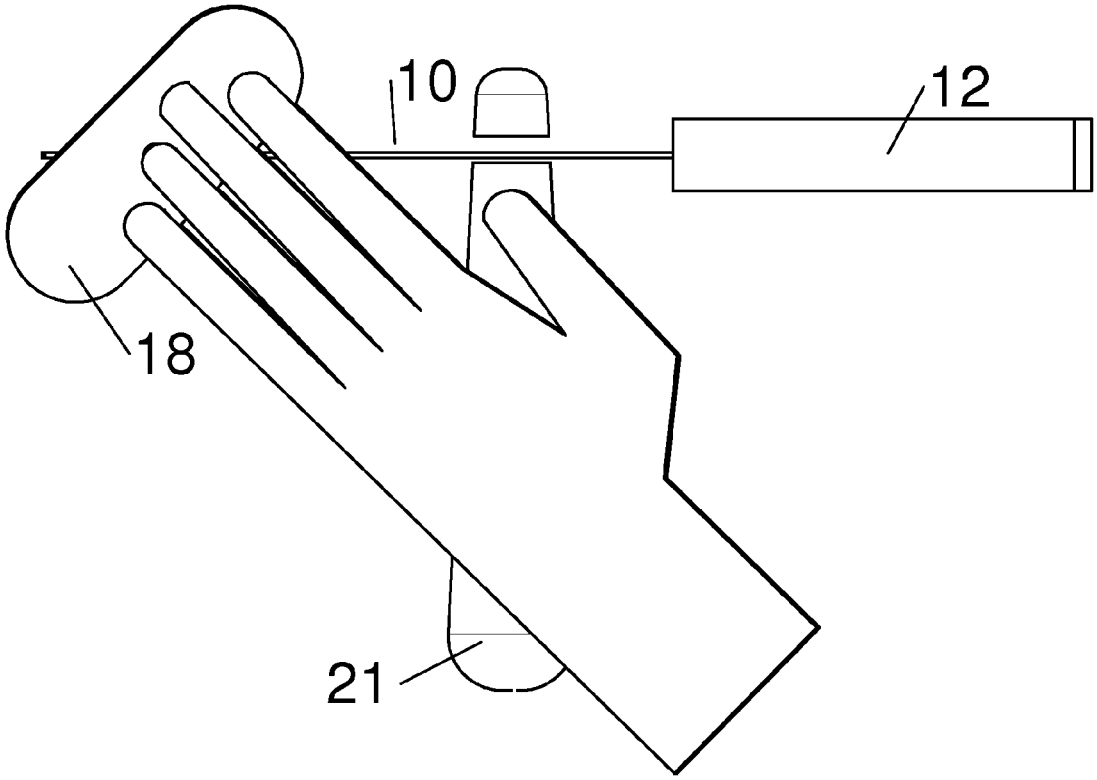
FIGS. 2A, 2B, 2C, 2D, and 2E are top plan views which illustrate the main embodiment of a double handle blade in use with the non-dominant hand on a secondary handle, controlling and assisting in the cutting of a food or other item as in FIG. 2A, depiction of the angle formed between secondary handle and blade as in FIG. 2B, and positions of a user's hand on the secondary handle controlling and cutting a food item in parallel position as in FIG. 2C, perpendicular position as in FIG. 2D, and on a round handle as in FIG. 2E.
Figure 2B:
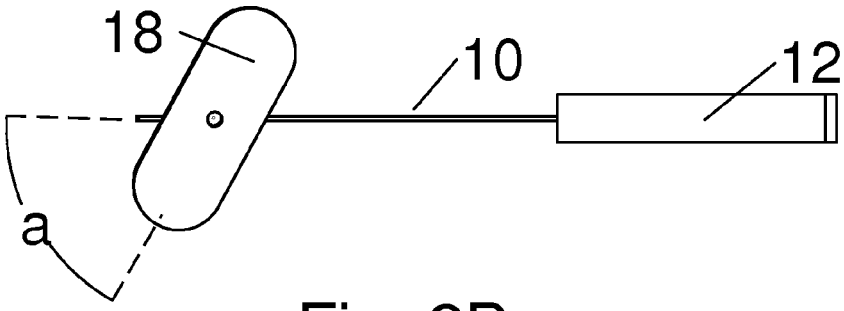

The operation of the main embodiment is illustrated in FIG. 2A (top view) showing the general positions of the user's non-dominant hand, secondary handle 18, object being cut (carrot 21 shown as example), blade 10, and primary handle 12. The palm and thumb of the non-dominant hand are kept close to blade 10 to position the object being cut whereas the four remaining fingers of the same hand press down on the secondary handle 18. The dominant hand grips primary handle 12 raising it to clear over the food or other item being cut, then pressing down to cut as the fingers on secondary handle 18 simultaneously press down the front of blade 10 assisting the dominant hand in cutting through the food item or other object. Secondary handle 18 may be free to rotate 360 degrees. However, using this method of assisting with the cut and positioning food or other items with the non-dominant hand the ideal angle (a) (FIG. 2B) formed between the long axis of secondary handle 18 to the long axis of blade 10 for a right handed person is between about 20 and 70 degrees in a plane about perpendicular to the blade. For a dominant left handed person the secondary handle 18 is simply rotated around and the corresponding angle (a) of the handle on the other side of the blade is employed. The unique arrangement of these embodiments in this position allow the fingers to be positioned more evenly over both sides of blade 10 providing downward leverage with minimal side torque while still allowing the palm and thumb to be close to blade 10 to position even short food and other items. Furthermore, the fingertips instead of the base of the fingers can be used to apply even and balanced downward pressure on the secondary handle. This utilizes the full length of the non-dominant hand and therefore maximizes the flexibility thereof as the fingertips on the secondary handle rise when the back of the blade is raised to clear the food or other item while simultaneously having the palm and thumb pin down the item.

Figure 2C:
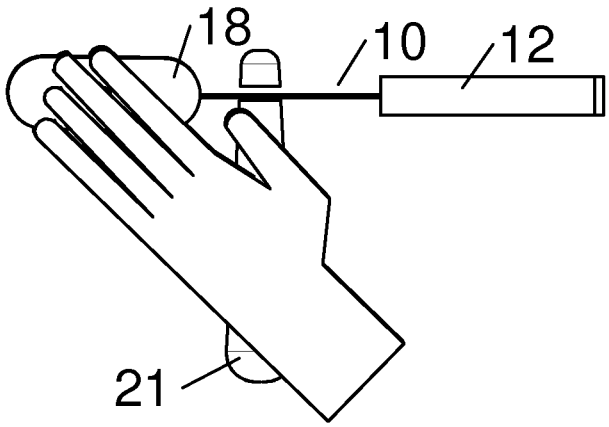

Other positions are less beneficial for using the cutting method described above. In double handle knives in which a secondary handle is mounted parallel to a blade, angle (a) is 0 degrees as shown in FIG. 2C. This position maximizes hand twisting as the index finger travels up and down more than the other fingers as the front of the blade remains pinned to the board and the back of the blade rises to clear the food or other item and then lowers to cut through it. Furthermore, the pinky finger has minimal or no contact with the secondary handle whereas the base of the index finger contacts the secondary handle causing the index finger to naturally exert significantly greater downward pressure than the other fingers. These factors increase the potential for hand and wrist strain.

Figure 2D:
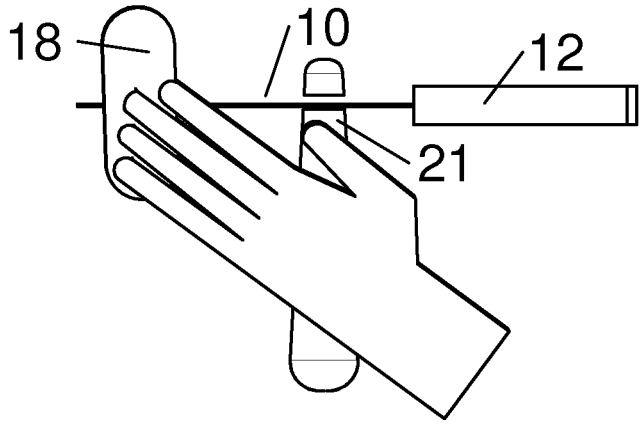
Figure 2E:
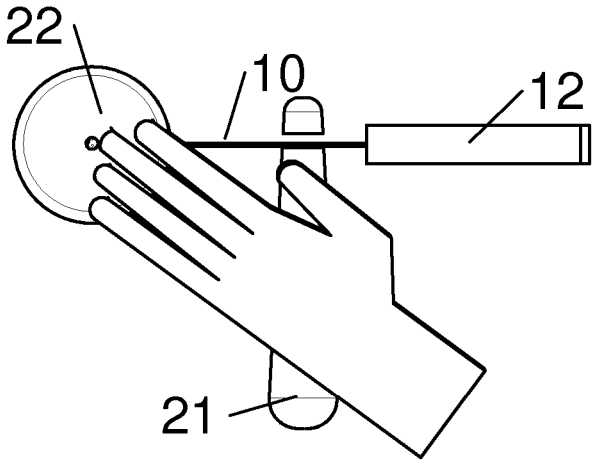

For a handle in a position perpendicular to the blade where angle (a) is 90 degrees as shown in FIG. 2D and for a round handle 22 able to accommodate four fingers as shown in FIG. 2E significant side torque is introduced because the fingers press down more on one side of the handle. This increases the likelihood for hand and wrist strain when cutting difficult objects.

The rotating double handle blade as described may allow all angles of the secondary handle relative to the blade to be quickly assumed which can be a highly useful feature when the non-dominant hand is not required to control the object being cut. Pressing down firmly on the secondary handle with the non-dominant hand can be done with the handle rotated to the best position that a particular cutting chore warrants, thereby extending the range of positions possible and minimizing arm and wrist fatigue especially for repetitive chopping chores or cutting difficult items like frozen foods. Alternative handles designs can further enhance this function as shown in the operation and advantages illustrated in FIGS. 5A, 5B, and 5C.

Figure 3A:
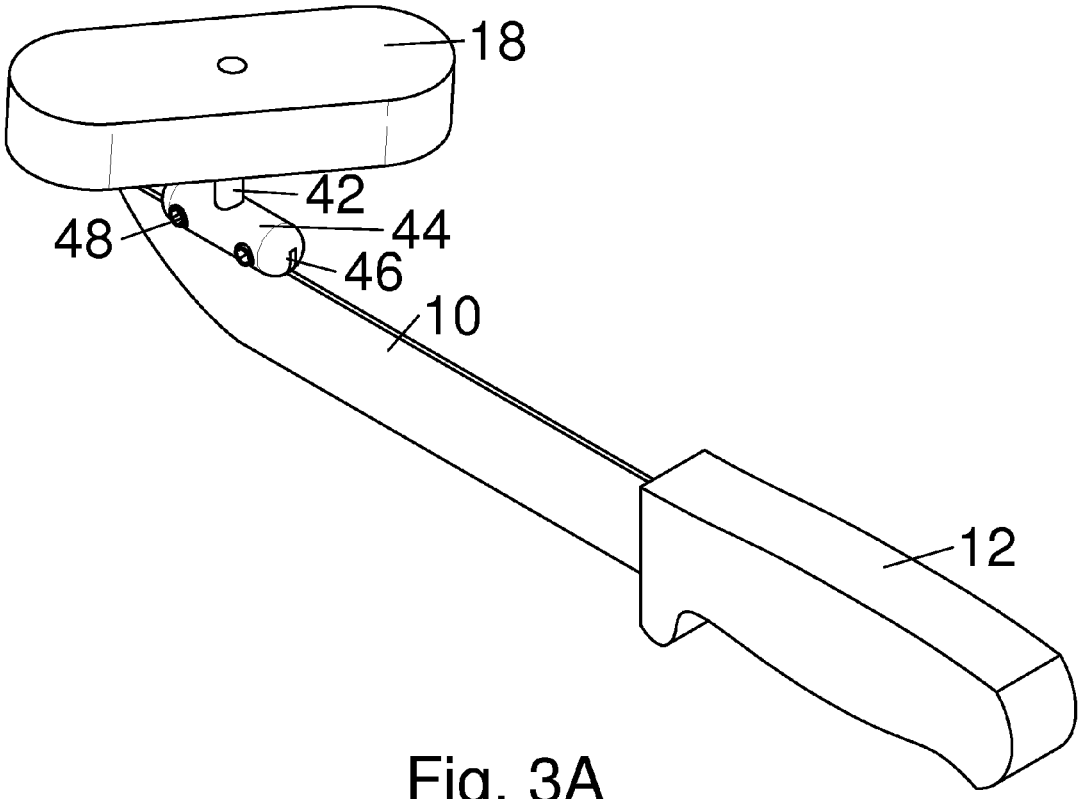
FIGS. 3A and 3B illustrate perspective views of a rotating double handle blade with a clamping body providing a reversible means to clamp the pivot post and secondary handle to the blade as in FIG. 3A and a rotating secondary handle attachment for conversion of a single handle knife into a rotating double handle blade as in FIG. 3B.

FIG. 3A illustrates an embodiment of the double handle blade with reversible means to attach a pivot post 42 to blade 10. Pivot post 42 is affixed to a stainless steel clamping body 44 having a slot 46 that fits over blade 10 and fastened with Allen head set screws 48. Secondary handle 18 is fitted over pivot post 42 and functions essentially as in the main embodiment by enabling the secondary handle 18 to pivot in a plane. The reversible design has the advantage that the secondary handle and pivot post 42 with clamping body 44 can be entirely removed, thereby converting the double handle blade into a conventional single handle blade for storage or for uses in which the pivot post might otherwise interfere with the cutting of an object.

Figure 3B:
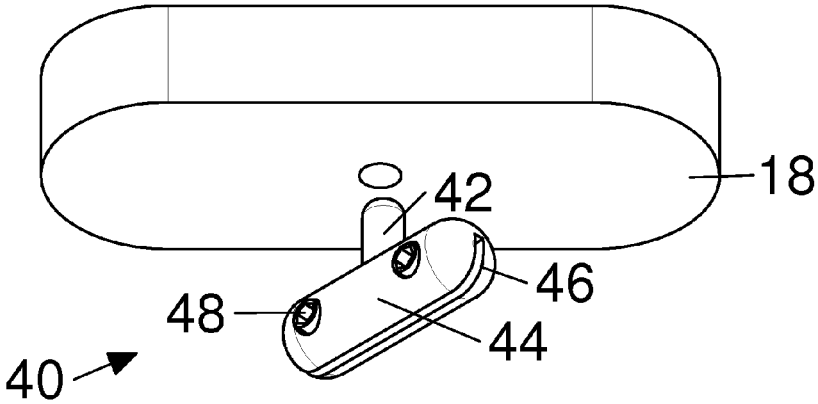

FIG. 3B illustrates a rotating secondary handle attachment 40 comprising pivot post 42 attached to clamping body 44 and secondary handle 18 as per the double handle blade embodiment illustrated in FIG. 3A but without the blade and handle which provides the option for converting any single handle blade into a rotating double handle blade by inserting the top of a single handed blade into slot 46 and tightening the Allen head screws 48. The secondary handle attachment may be used with blades other than knives, such as a saw blade, as the attachment connects to planar objects and is for the purpose of applying downward force. Other uses may become apparent to those practiced in the art.

Other secondary handles designs such as those illustrated in FIGS. 5A, 5B, 5C, and 5D may be used with the clamping body and pivot post. Furthermore, there are many ways to design a pivot post that reversibly attaches to a blade.

Figure 4A:
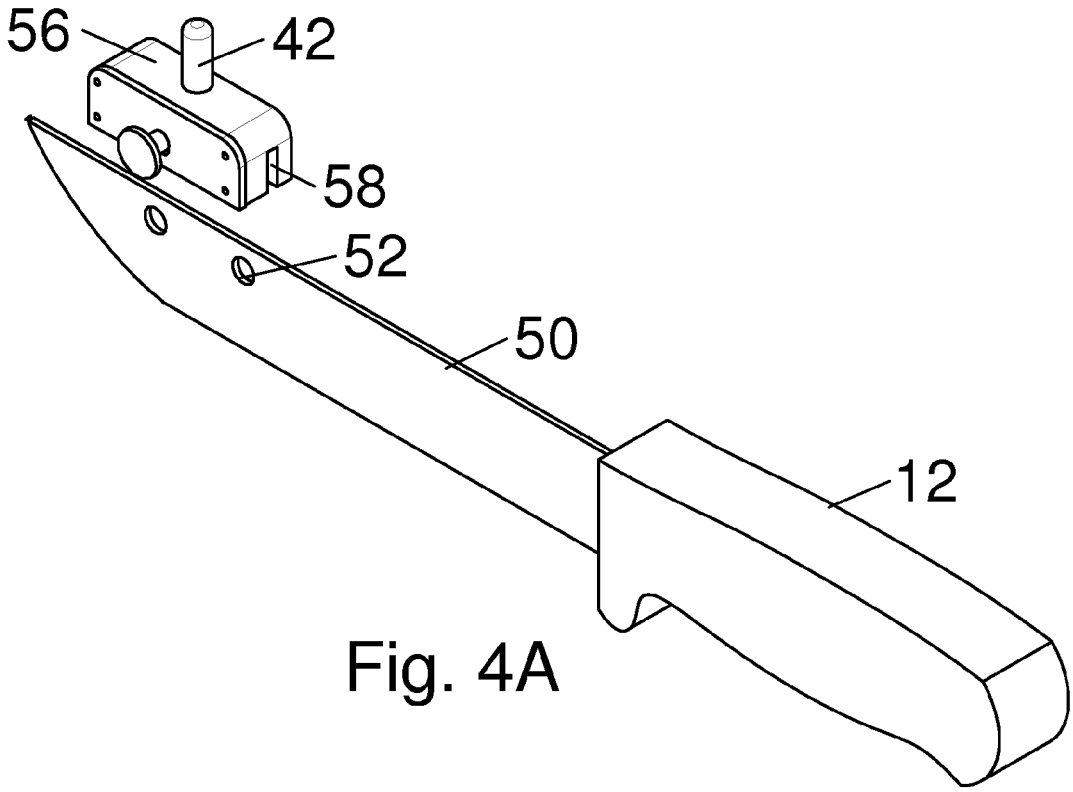
FIG. 4A is an exploded perspective view which illustrates a quick release mechanism to release the pivot post and modifications to the blade which facilitate the attachment and positioning of the quick release mechanism.
Figure 4B:
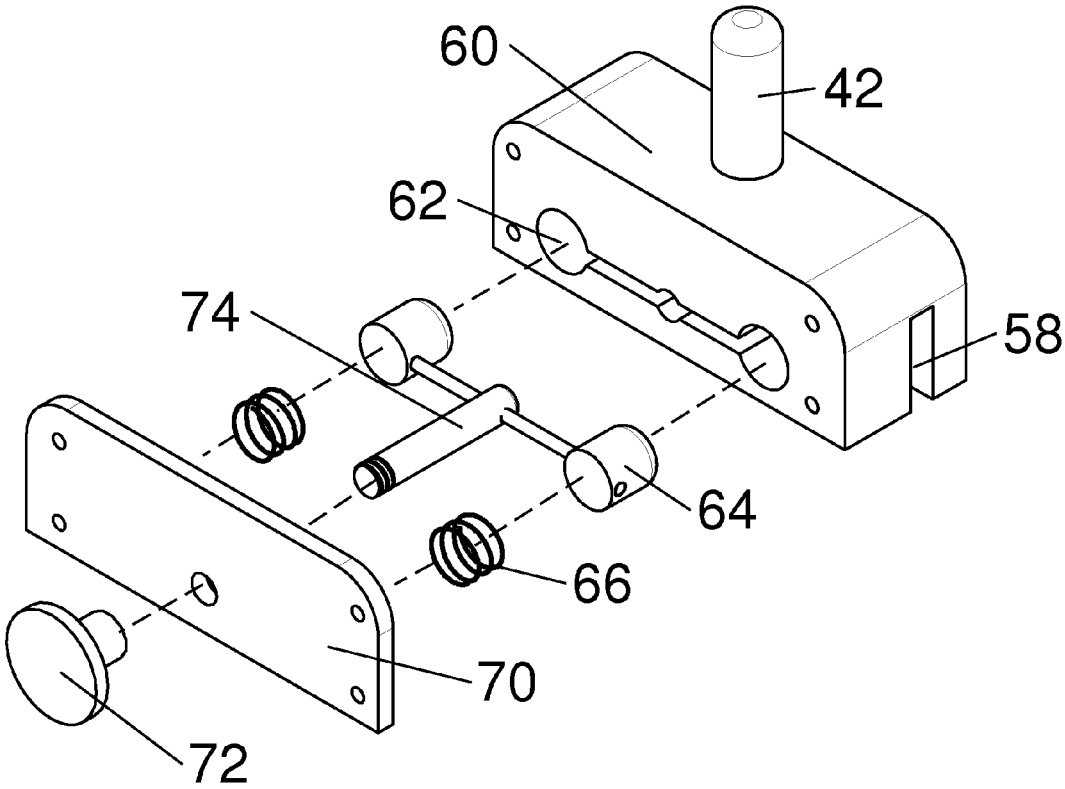
FIG. 4B is a close-up exploded detail perspective view of the quick release mechanism of FIG. 4A.

FIG. 4A illustrates a double handle blade embodiment with quick release means to attach a pivot post to a blade which utilizes a modification to the blade to help position and attach the pivot post. Blade 50 has two holes 52 and a primary handle 12 extending off the back end. A round bar pivot post 42 is permanently attached to a lower mounting unit 56 Lower mounting unit 56 has a slot 58 to fit over the blade 50 and is aligned for attachment such that holes 52 in blade align with holes 62 in lower mounting unit (FIG. 4B), being locked together by two inserted pins 64 (FIG. 4B). FIG. 4B is an exploded view of the lower mounting unit with pivot post showing the body 60 having two blind holes 62 into which inserts two pins 64 which pass through slot 58 under spring 66 tension against end plate 70. Pulling on a release knob 72 pulls attached connecting rods 74 for engagement and disengagement of pins 64 with slot 58, thereby providing a quick attach and release mechanism to blade 50. Secondary handles such as those described in FIG. 1 and FIGS. 5A, 5B, and 5C may then be used to attach to the pivot post 54.

FIGS. 5A, 5B, 5C and 5D illustrate examples of additional embodiments of the secondary handle that function with the various embodiments of the pivot post designs disclosed. These various embodiments may be made from molded plastic or other suitable means and have a hole 84, 94, or 103 or may have an inserted bushing or bearing to provide the hole to fit over the pivot post. Additionally, theses handles may use fasteners or tensioners as discussed for the press pad 18 version of the secondary handle. The long axis of these secondary handles is of sufficient length to allow multiple fingers to grip or press down on and the short axis or width sufficient length to press down on or grip around.

Figure 5A:
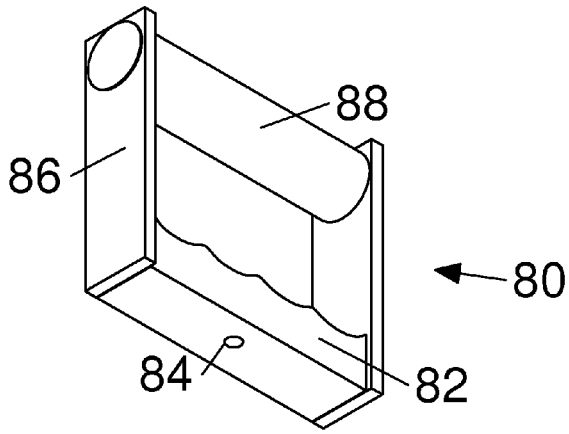
FIGS. 5A, 5B, and 5C illustrate additional embodiments of secondary handle design such as a bi-level version as in FIG. 5A, a crosswise-grip version as in FIG. 5B, a T-grip version as in FIG. 5C, and a safety-handle version as in FIG. 5D.

FIG. 5A illustrates a bi-level version of a secondary handle 80. Lower section 82 has a centrally located hole 84 and may function identical to the secondary handle 18 described in the primary operation of the main embodiment. The width of lower section 82 provides sufficient surface for the fingers to comfortably press down on but preferably less than two inches as wider widths introduce unnecessary side load as discussed for the primary operation of the main embodiment. To it, connected by two crossmembers 86 is an upper section 88 with a round hand grip enabling the non-dominant hand to wrap around for the application of downward pressure. The upper section 88 may be used when the non-dominant hand is not needed to control the food or other item being cut by providing even more versatility in the positions that the hands and arms may assume in cutting difficult objects such as frozen foods, pumpkins, etc. including a position in which the lower arm presses directly downward over the wrist with the non-dominant hand wrapped fully around the upper section 88 of the handle thus making fully available the power of the non-dominant arm and hand.

Figure 5B:
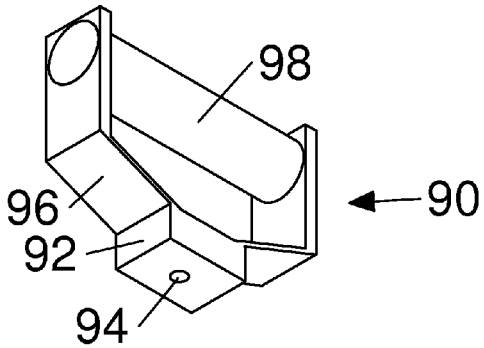

FIG. 5B illustrates a crosswise-grip version of the secondary handle 90 that provides the same feature and operation as the upper section in FIG. 3A but without the lower section feature. A base 92 with hole 94 to accommodate the pivot post has brackets 96 supporting round handle grip 98 upon which the non-dominant hand may wrap around.

Figure 5C:
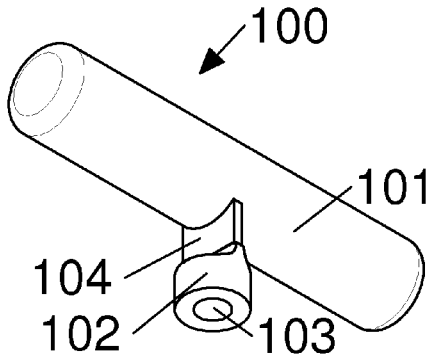

FIG. 5C illustrates a T-grip version of the secondary handle 100 which comprises a base 102 with a hole 103 to accommodate a pivot post being connected to the round handle grip 101 by a connecting member 104 of thin cross section to pass with minimum discomfort between the middle and ring fingers when the fingers are used to wrap around the round handle grip.

Figure 5D:
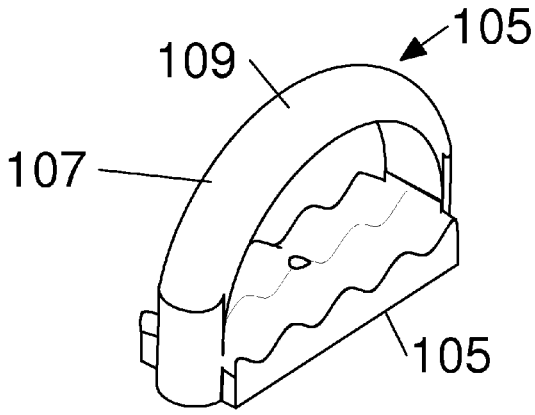

FIG. 5D illustrates a safety secondary handle 105 with secondary handle 106 and attached safety guard 107. The safety guard which forms an arch and also has a rounded outer surface 109 prevents the knife from being stored with the secondary handle down and the cutting edge of the blade facing up and thus serves to prevent accidental injury. A safety guard may be placed on other handle designs such as secondary handle 80, 90 or 100.

The handles illustrated in FIGS. 5B and 5C are also useful for double handed sawing motions as for when using a serrated blade, and when used in conjunction with a clamping body as shown in FIG. 3B could conceivably convert a wood saw into a double handled saw.

FIGS. 6A-6E illustrate a pivot post attached to a blade by means of a mounting unit with pressurized groove. Pressure can be exerted by, but not limited to, coil springs, leaf springs, resilient pads, rubberized grooves, silicone pads, or magnetic attraction. These may be used as reversible secondary handles in double handle knives or as attachments to convert a single handle blade to a double handle blade.

Figure 6A:
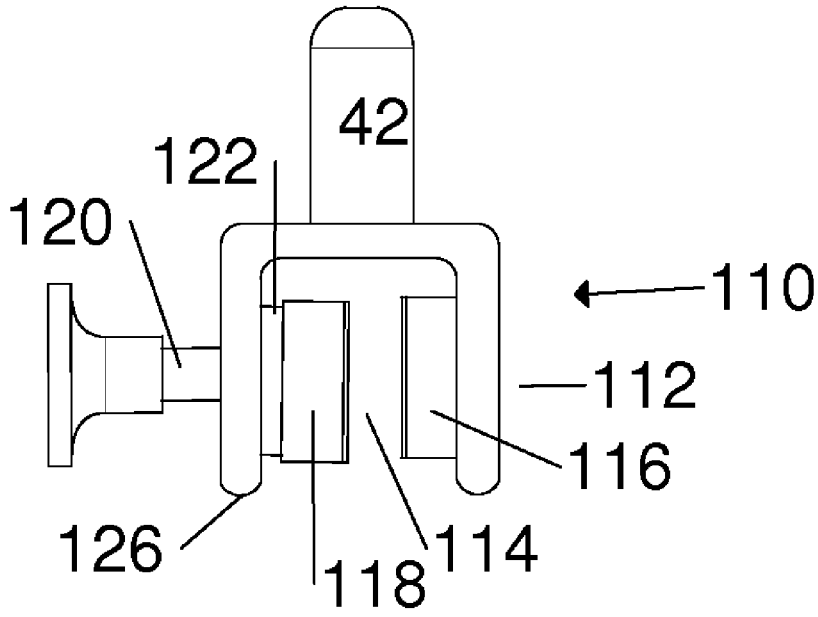
FIG. 6A (side elevation view) and 6B (perspective view) illustrate an embodiment for pressure means consisting of a magnetic mounting unit for the secondary handle.
Figure 6B:
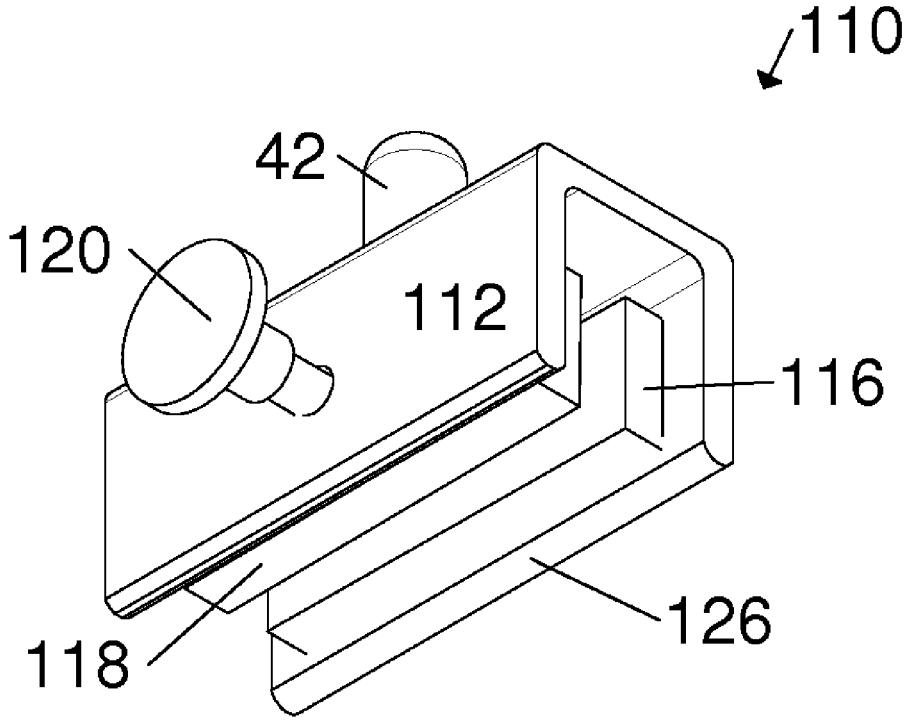
FIG. 6C (side elevation view), FIG. 6D (perspective view) and FIG. 6E (exploded perspective view) illustrate a press-pad secondary handle mounting unit with silicone pads.

FIG. 6A (side elevation view) and FIG. 6B (perspective view) illustrate a magnetic mounting unit 110 having a pivot post 42 to rotatably mount a secondary handle separated from an end portion 126 by a housing 112 or depth portion. This depth portion may have a central cavity 114 within which are a floating flat bar magnet 118 opposite a fixed flat bar magnet 116 between which forms a slot 124 into which a blade inserts. A retractor knob and attached rod 120 may pass through a hole in housing 110 and thread into a backing plate 122 fastened to floating flat bar magnet 118 to facilitate the quick release or attachment of blade.

Magnetic mounting unit 110 mounts to any blade without tools or modifications and can accommodate a variety of thicknesses due to the floating nature of magnet 118. Furthermore, it mounts to even stainless steel (with low magnetic attraction) or even non-metallic ceramic blades, since the two magnets 116 and 118 attract each other. Magnets 116 and 118 can be any appropriate magnetic material, such as, for example, but limited to, neodymium or samarium cobalt.

Figure 6C:
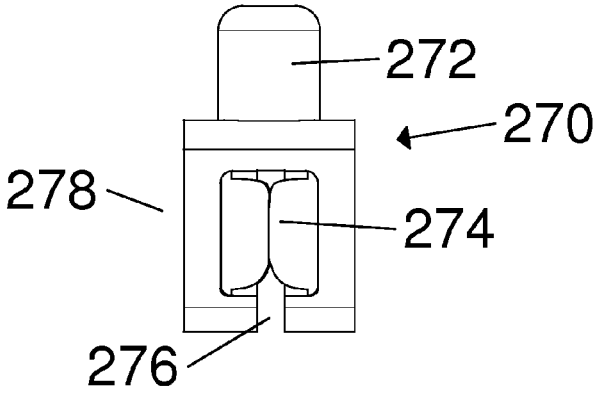
Figure 6D:
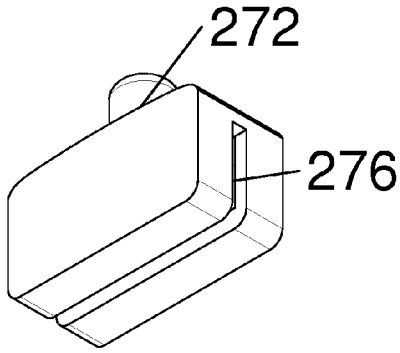
Figure 6E:
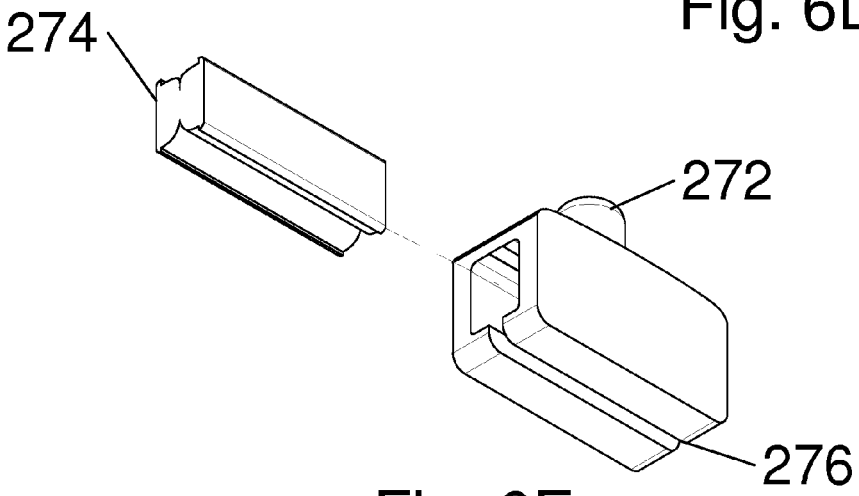

FIG. 6C (side elevation view), FIG. 6D (perspective view) and FIG. 6E (exploded perspective view) illustrate a press-pad mounting unit 270 with pivot post 272 which rotatably mounts a secondary handle, separated from end portion by a depth or housing 278 having a slot 276 opening to removable pads 274. Pads 274 exert pressure on an inserted blade to hold the secondary handle in place and may be made of silicone or other rubberized material.

FIGS. 7A-7E illustrate fixed angle version of secondary handles. Other styles of handles such as those illustrated in FIGS. 80, 90, 100 could conceivable be used with the fixed means of attachment described in FIGS. 7A-7D.

Figure 7A:
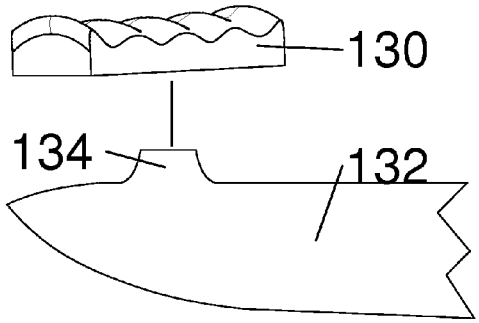
FIG. 7A (close-up exploded side elevation view), FIG. 7B (close-up side-elevation view) illustrate an embodiments of fixed angle double handle blades.
Figure 7B:
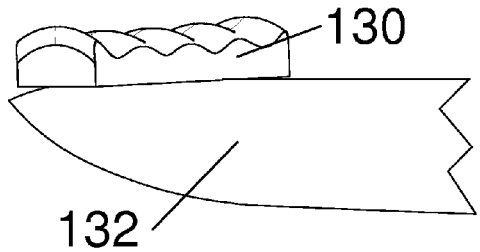
FIG. 7C-7E illustrate perspective views of embodiments of reversibly attached fixed angle secondary handle designs.

FIG. 7A (close-up exploded side-elevation view) and FIG. 7B (close-up side-elevation view) illustrate a double handle knife having a blade 132 with an integral tang 134. A second handle may be cast around the tang such that a fixed angle of the secondary handle 130 forms an angle (a) (see FIG. 2B) between 20 and 70 degrees to the blade thereby providing an optimal angle for the cutting method described for the primary operation of the main embodiment. To further secure the molded handle, tang 134 may have a hole(s) and a retainer pin could further be inserted before casting. FIG. 7B shows the second handle 130 cast around the tang on the blade 132.

Figure 7C:
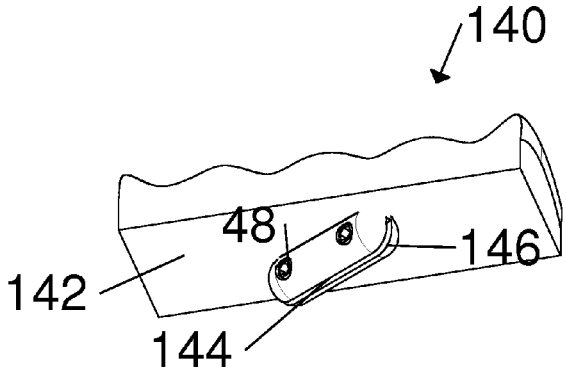

FIG. 7C illustrates a perspective view of a fixed-angle secondary handle attachment. A handle press-pad 142 is separated from the end portion 144 by a depth portion that may be a protruding lower mounting section 148 having at its bottom-a slot 146 transverse to the long axis of the handle which slips over a blade to be locked in place with a Allen head set screw 149. The angle of the transverse slot 146 is such that it will position the fixed angle secondary handle attachment 140 at an angle (a) (see FIG. 2B) of 45 degrees (+ or −25 degrees) to the blade to which it attaches thereby converting a single handle blade into a double handle blade with an optimal angle of secondary handle for the cutting method described for the primary operation of the main embodiment. The protruding lower mounting section may have a tang on its upper surface around which a secondary handle may be cast.

Figure 7D:
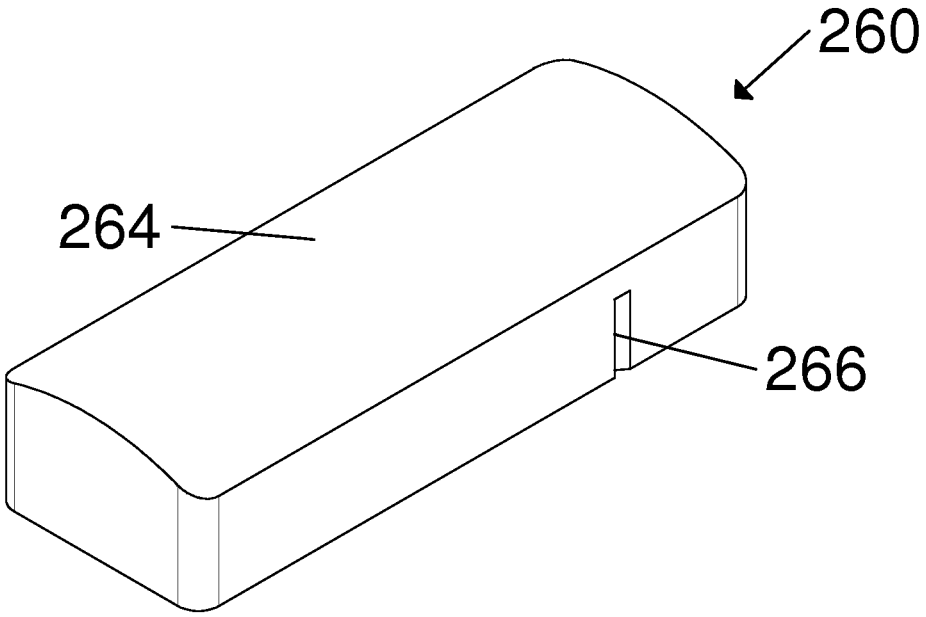
Figure 7E:
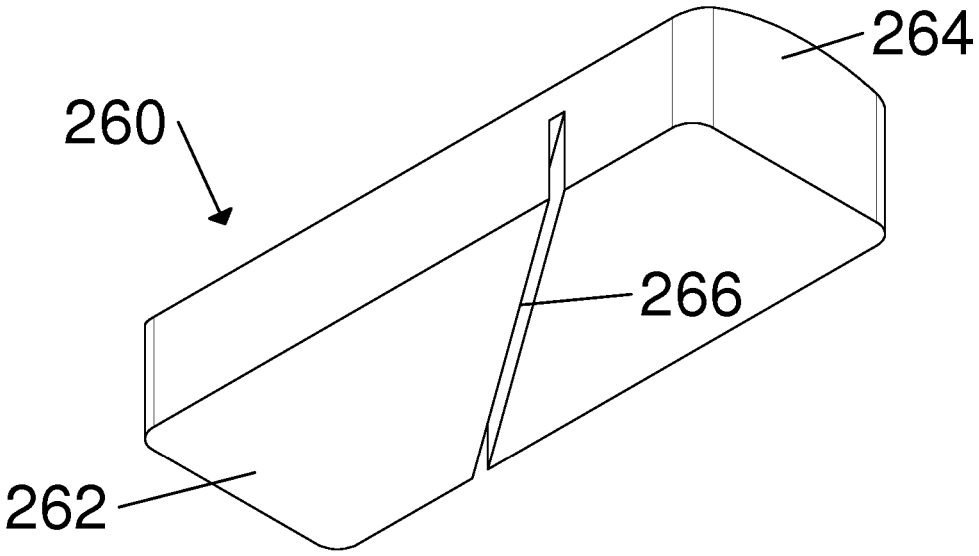

FIGS. 7D and 7E illustrate perspective views of another fixed angle secondary handle attachment 260 wherein the attachment means is defined by an end portion 262 and a depth portion, wherein the end portion 262 is separated from the press-pad upper portion 264 by the depth portion. The bottom of the depth portion has a slot 266 to removably receive a portion of a cutting blade. The press-pad upper portion 264 may be flexible which allows the slot 266 to compress against the blade in order to hold the handle in place. Alternatively, the top section may be rigid. Additionally, the slot may have silicone or rubberized pads or other means such as an Allen set screw to secure the handle onto a blade. The angle of the transverse slot 266 is such that it will position the fixed angle secondary handle attachment 260 at an angle (a) (see FIG. 2B) of 45 degrees (+ or −25 degrees) to the blade to which it attaches thereby converting a single handle blade into a double handle blade with an optimal angle of secondary handle for the cutting method described for the primary operation of the main embodiment.

Other means of attachment for a secondary handle at a fixed angle may be used such as those with a lower section having rubberized or silicone pads or magnets as described for the rotatable secondary handle in FIG. 6. The fixed angle secondary handle 130 is without the rotating advantage of the main embodiment which limits the overall positions that the hands and arms can assume in finding the most effective position in situations where the secondary hand is not needed to control the food or other item during the cut. Additionally, separate left handed and right handed blades or attachments would be required if the handles were permanently attached. However, a potential advantage is that it may be cheaper to manufacture while still allowing the cutting method described for the primary operation of the main embodiment.

Figure 8A:
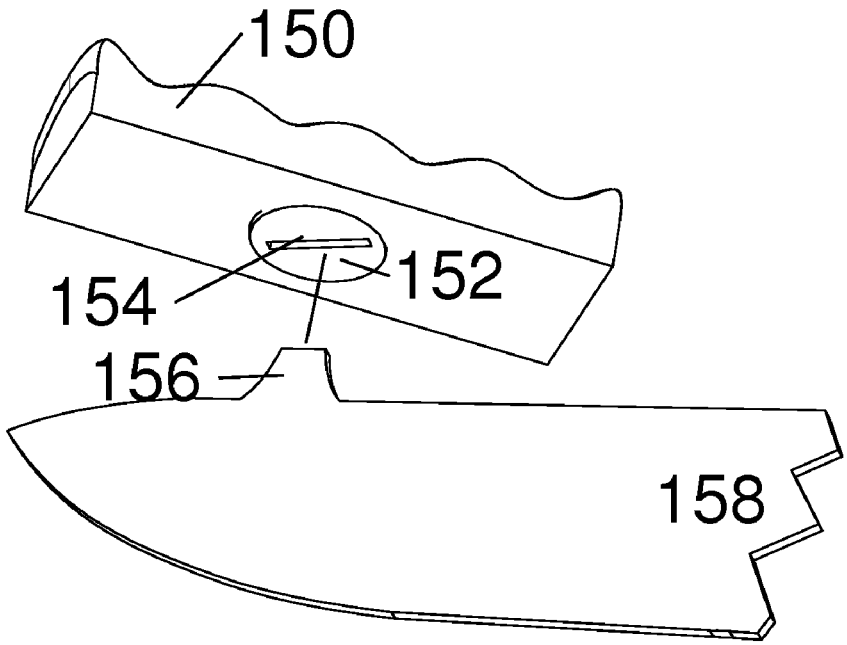
FIG. 8A is a close-up exploded perspective view which illustrates an embodiment of a double handle blade with a rotatable handle which attaches directly to a tang on the knife blade.
Figure 8B:
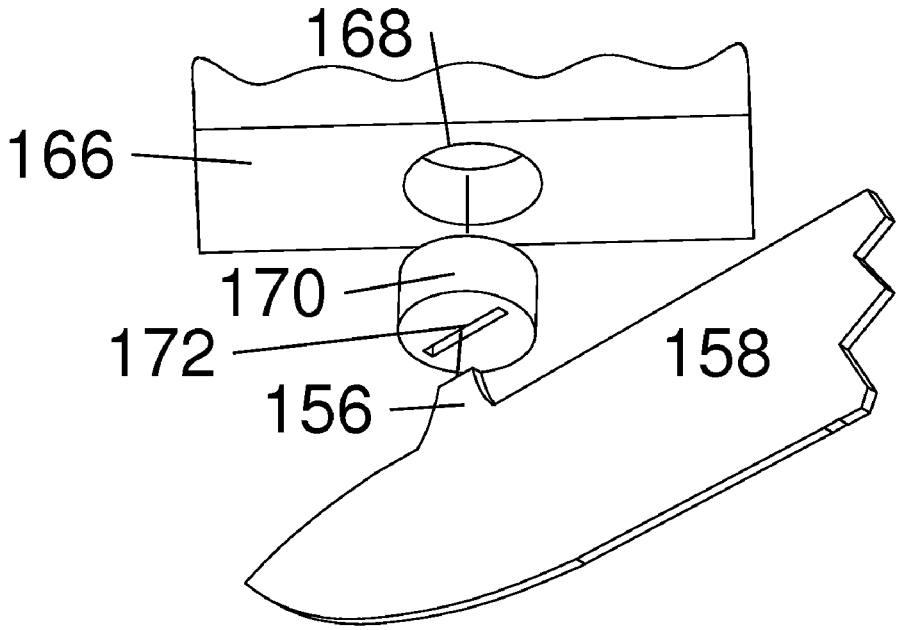
FIG. 8B is a close-up exploded perspective view which illustrates an embodiment of a double handle blade with tang over which a pivot post is cast.

FIGS. 8A and 8B illustrate double handle blades with tangs by which rotatable secondary handles are attached. FIG. 8A is a close-up exploded perspective view illustrating a double handle blade with a secondary handle 150 having a bushing 152 with a rotatable central core having a internal slot 154 which may removably fit over tang 156 on blade 158 thereby enabling the secondary handle 150 to pivot over the top of the blade 158.

FIG. 8B is a close-up exploded perspective view illustrating a double handle blade with a pivot post 170 with an internal slot 172 which may be permanently fitted over tang 156. Pivot post 170 may be made of plastic and cast over tang 156 which may have holes for added retention. Second handle 166 has a hole 168 which fits over pivot post 170 allowing the rotation of the second handle. Fastening and tensioning means may be used to secure the handle in a favorite position. The advantage of these embodiments is that tang 156 being integrally stamped or cast with the blade 158 may be stronger than other attachment means.

FIG. 9A is an exploded detail perspective view illustrating an embodiment of a press pad 18 version of the secondary handle with tensioner. Secondary handle 180 has a tensioner hole 182 intersecting beyond hole 184 into which inserts beyond hole 184 a tensioner band with threaded housing 186 into which a tensioner knob 188 is threaded. When this press-pad and tensioner assembly is inserted over the pivot post, the band 190 is tightened against the pivot post by turning the tensioner knob 188 thus having the effect of variably controlling the free rotation of the secondary handle around the pivot post or even locking it in position. The tensioner band can be easily removed for cleaning.

FIG. 9B is a close-up side-elevation view illustrating an embodiment of an O-ring 200 which fits into a groove 202 in a pivot post 204 which is attached to a blade 206 and provides tension to the rotation of a secondary handle so that it doesn't rotate out of position easily or slip off. Many alternative means of tensioning the handle are possible such as splitting of a pivot post and springing it outwards. Other versions of secondary handles 80, 90, 100 may have similar tensioning mechanisms and be used with the double handle blade or attachments.

Figure 10:
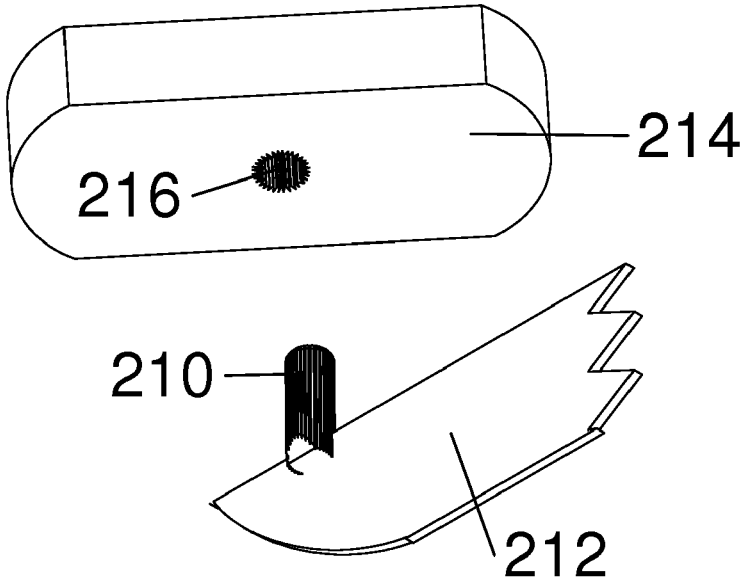
FIG. 10 is a close-up exploded perspective view that illustrates an embodiment of a double handle blade having indexable rotation means of a splined post and secondary handle with internal splines.

FIG. 10 is a close-up perspective view illustrating an embodiment of a double handle blade having indexable means of rotation comprising a splined post 210 attached to blade over which inserts a secondary handle 214 having mating internal splines 216. If splined post 210 has 36 splines then 10 degree angles of the handle may be indexed by rotating the handle one tooth. The splined post may be permanently attached to the blade. Alternatively, the splined post may be reversibly attached to a blade by means described above for reversibly attaching a pivot post, and may be used as an attachment to convert a single handle blade into a double handle blade. The advantage of this system is that the ideal angle can be found for both positioning a food or other item and assisting with its cut and it will not slip or change. The disadvantage is that the handle needs to be removed and reinserted if a slightly different angle is desired. Other indexable means of rotation are shown in FIG. 12.

Figure 11:
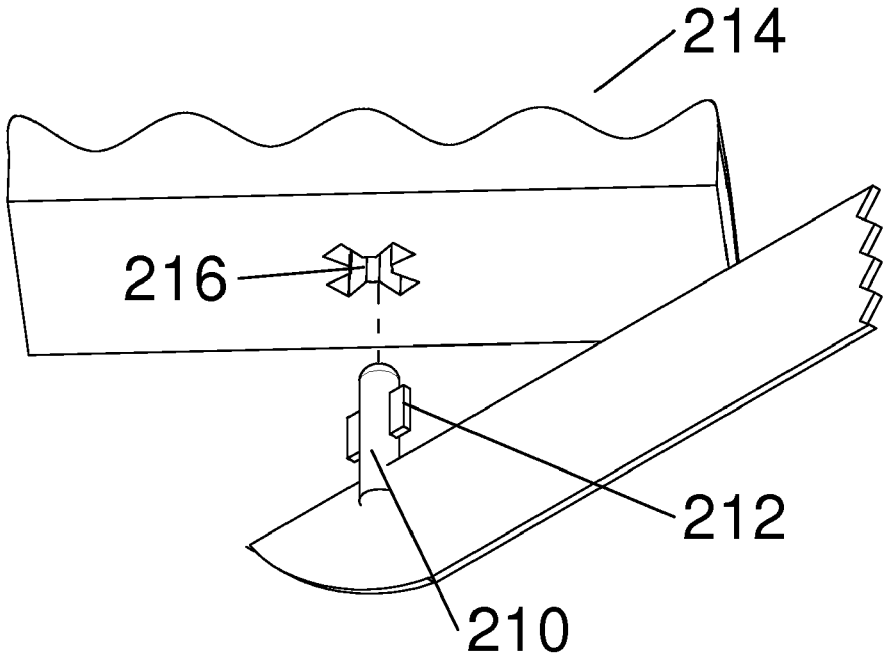
FIG. 11 is an exploded close-up perspective view of an embodiment of a double handle blade in which the secondary handle rotation is limited by pivot post tabs and handle slots.

FIG. 11 is an exploded close-up perspective view illustrating an embodiment of a double handle blade with pivot post 220 having tabs 222 and a secondary handle 224 with hole having slots 226 which may be used to effectually limit the rotation of the double handle blade to within an ideal range for both controlling and chopping vegetables as described in the operation of the main embodiment of FIG. 1. Complimentary grooves are used to index the blade for right handed or left handed users.

Figure 12A:
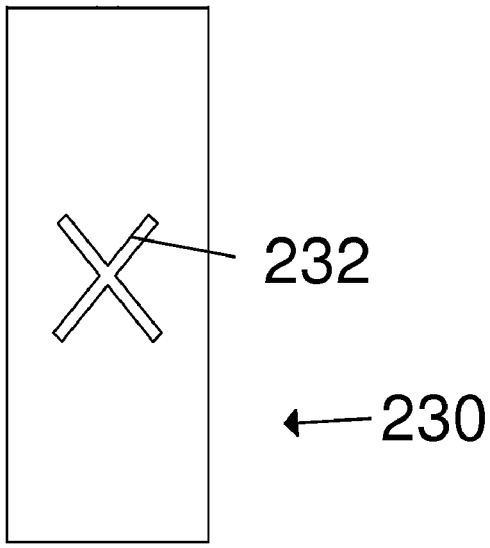
FIG. 12A is a bottom view of an embodiment of a secondary handle having indexable rotation means of attachment with secondary handle slots that attaches to a tang of a blade.

FIG. 12 shows additional examples of indexable means of rotation. FIG. 12A is a bottom view illustrating an embodiment of a secondary handle 230 that attaches to a blade having at least two slots 232 into any one of which the tang of a blade may be inserted. The slots are positioned such that an angle (a) between 20 and 70 degrees may be formed (as described in FIG. 2). One slot forms angle (a) suitable for a right handed person and the other for a left handed person. Conveniently, the second handle is easily removable for storage.

Figure 12B:
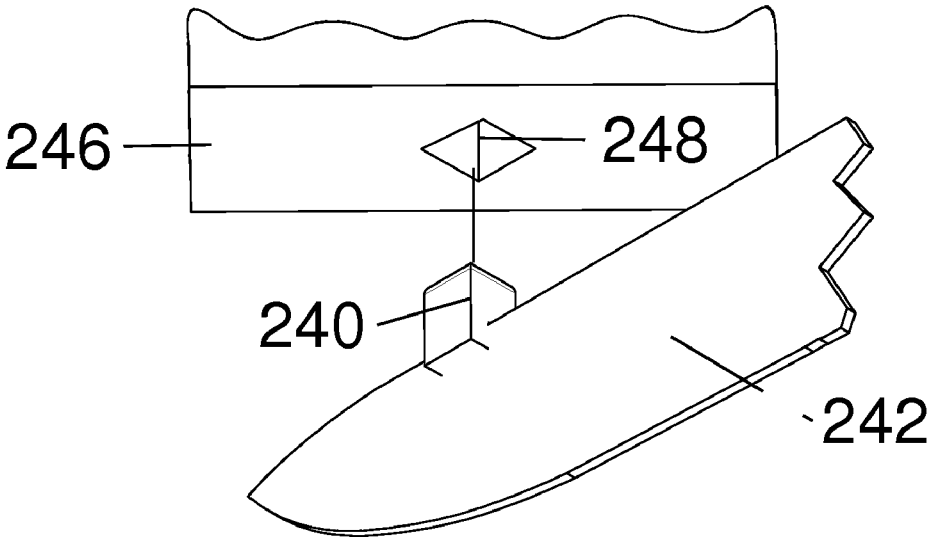
FIG. 12B is a close-up exploded perspective view of a double handle blade with indexable rotation means of secondary handle attachment to a square post attached to a blade.

FIG. 12B is a close-up exploded perspective view of a double handle blade having an second handle 246 with a square hole 248 which fits over a square post 242 permanently attached to a blade 242. The handle may be positioned with an angle (a) at 45 degrees (as described in FIG. 2B) for either a right handed person or a left handed person depending upon which orientation the handle is inserted in. There are many ways to make an indexable handle such as shown in FIG. 10 and FIG. 12 that are given by way of example.

The embodiments showing the means of attachment of a round pivot post as shown in FIG. 1-FIG. 4, FIG. 6 and FIG. 8 could similarly be used for the attachment of indexable means as shown in FIG. 10 or FIG. 12 for example. While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

I claim:

1. A handle assembly configured to be supported by a back edge of a knife blade during a cutting function comprising:

a handle portion having a longitudinal axis sufficiently wide to accommodate multiple fingers and a means for receiving centrally located on the longitudinal axis;

a second portion having a second axis perpendicular to the longitudinal axis, a top portion, and a bottom portion with a slot configured to receive the back edge of the blade;

wherein the top portion is received by the means for receiving in a way that allows the handle portion to rotate in a plane substantially perpendicular to the second axis relative to the second portion when the assembly is supported by the back edge of the blade.

2. The handle assembly of claim 1, wherein the second portion is a post and the means for receiving is an aperture.

3. The handle assembly of claim 2, wherein the post includes an O-ring.

4. The handle assembly of claim 1, wherein the handle portion is circular.

5. The handle assembly of claim 1, wherein the handle portion is elongated.

6. The handle assembly of claim 1, wherein the handle portion has a graspable portion spaced from the means for receiving.

7. The handle assembly of claim 1, wherein the handle portion further comprises a pressing portion which incorporates the means for receiving and a graspable portion spaced from the pressing portion.

8. The handle assembly of claim 1, wherein the handle portion further comprises a safety guard.

9. The handle assembly of claim 1, wherein the handle portion further comprises a tensioner.

10. The handle assembly of claim 9, wherein the tensioner comprises a band that is aligned with the means for receiving and a threaded knob that tightens the band.

11. A handle assembly configured to be supported by a back edge of a knife blade during a cutting function comprising:

a handle portion having a longitudinal axis and a means for receiving centrally located on the longitudinal axis;

a second portion having a second axis perpendicular to the longitudinal axis, a top portion, and a bottom portion with a slot configured to receive the back edge of the blade;

wherein the top portion is received by the means for receiving in a way that allows the handle portion to rotate in a plane substantially perpendicular to the second axis relative to the second portion.

12. The handle assembly of claim 11, wherein the handle portion is circular.

13. The handle assembly of claim 11, wherein the handle portion is elongated.

14. The handle assembly of claim 11, wherein the handle portion has a graspable portion spaced from the means for receiving.

15. The handle assembly of claim 11, wherein the handle portion further comprises a pressing portion which incorporates the means for receiving and a graspable portion spaced from the pressing portion.

16. The handle assembly of claim 11, wherein the handle portion further comprises a safety guard.

17. The handle assembly of claim 11, wherein the bottom portion has a tightening screw extending through a side of the bottom portion into the slot to engage the blade when received in the slot.

18. The handle assembly of claim 11, wherein the bottom portion has spring loaded pins with a quick release knob.

19. The handle assembly of claim 11, wherein the bottom portion has a means for moving.

20. The handle assembly of claim 19, wherein the slot has a fixed flat bar magnet and a floating bar magnet that is in communication with the means for moving.

21. The handle assembly of claim 11, wherein the slot has at least one pad.

22. The handle assembly of claim 21, wherein the at least one pad includes a pair of opposing pads.

23. A handle assembly configured to be supported by a back edge of a knife blade during a cutting function comprising:

a handle portion having a longitudinal axis and a means for receiving centrally located on the longitudinal axis;

a second portion having a center axis perpendicular to the longitudinal axis and a bottom portion with a slot configured to receive the back edge of the blade;

wherein the second portion is entirely received by the means for receiving in a way that allows the handle portion to rotate in a plane substantially perpendicular to the center axis relative to the second portion when the assembly is supported by the back edge of the blade.

24. The handle assembly of claim 23, wherein the handle portion has a substantially wavy shaped upper portion.

25. The handle assembly of claim 23, wherein the second portion is a substantially cylindrical shaped bushing.

26. A knife comprising:

a blade having a first longitudinal axis, a bottom cutting edge, and a top edge with a post including at least one projection;

a primary handle extending from a rear end of the blade and a secondary handle with a second longitudinal axis and a aperture with at least one groove; wherein the at least one projection is aligned with the at least one groove thereby allowing the post to be received by the aperture in a manner where an angle between the first longitudinal axis and the second longitudinal axis is fixed; and the secondary handle being within a plane located above the top edge of the blade and the plane being substantially perpendicular to a plane defined by the top edge and the bottom cutting edge of the blade.

27. The knife of claim 26, wherein the at least one groove includes a plurality of grooves and the at least one projection includes a plurality of projections.

28. A knife comprising:

a blade having a first longitudinal axis, a bottom cutting edge, and a top edge with a post having at least one corner;

a primary handle extending from a rear end of the blade and a secondary handle with a second longitudinal axis and an aperture having at least one corner;

wherein the at least one corner of the post is aligned with the at least one corner of the aperture thereby allowing the post to be received by the aperture in a manner where an angle between the first longitudinal axis and the second longitudinal axis is fixed; and the secondary handle being within a plane located above the top edge of the blade and the plane being substantially perpendicular to a plane defined by the top edge and the bottom cutting edge of the blade.

29. The knife of claim 28, wherein the at least one corner of the aperture includes four corners and the at least one corner of the post includes four corners.

30. A handle assembly configured to be supported by a back edge of a knife blade during a cutting function comprising:

a handle portion with a longitudinal axis and a aperture with at least one groove;

a second portion having a second axis perpendicular to the longitudinal axis, a top portion including a post having at least one projection, and a bottom portion with a slot configured to receive the back edge of the blade;

wherein the at least one projection is aligned with the at least one groove thereby allowing the post to be received by the aperture in a manner where an orientation of the handle portion is fixed relative to the second portion.

31. A handle assembly configured to be supported by a back edge of a knife blade during a cutting function comprising:

a handle portion with a longitudinal axis and a aperture with at least one corner;

a second portion having a second axis perpendicular to the longitudinal axis, a top portion including a post having at least one corner, and a bottom portion with a slot configured to receive the back edge of the blade;

wherein the at least one corner of the post is aligned with the at least one corner in the aperature thereby allowing the post to be received by the aperture in a manner where an orientation of the handle portion is fixed relative to the second portion.

* * * * *